United States Patent [19]

Miura et al.

[11] Patent Number: 5,062,766

[45] Date of Patent: Nov. 5, 1991

[54] TURBO COMPRESSOR

[75] Inventors: Haruo Miura, Ibaraki; Yasuo Fukushima, Tsuchiura; Hideo Nishida; Hiromi Kobayashi, both of Ibaraki; Takeo Takagi, Tsukuba, all of Japan

[73] Assignee: Hitachi, Ltd., Tokyo, Japan

[21] Appl. No.: 406,299

[22] Filed: Sep. 12, 1989

[30] Foreign Application Priority Data

Sep. 14, 1988 [JP] Japan ..... 63-228726
Sep. 14, 1988 [JP] Japan ..... 63-228744

[51] Int. Cl.[5] ..... F01D 1/02

[52] U.S. Cl. ..... 415/199.1; 415/208.3; 415/211.2

[58] Field of Search ..... 415/198.1, 199.1, 199.2, 415/179, 208.1, 208.2, 208.3, 211.2, 143, 93, 97, 99, 100; 416/223 B

[56] References Cited

U.S. PATENT DOCUMENTS

| | | | |
|---|---|---|---|
| Re. 32,462 | 7/1987 | Yoshinaga et al. | 415/208.3 |
| 2,397,816 | 4/1946 | Sorensen | 415/199.1 |
| 3,802,795 | 4/1974 | Nyeste et al. | 415/199.1 |
| 4,224,010 | 9/1980 | Fujino | 415/199.2 |
| 4,315,715 | 2/1982 | Nishiguchi et al. | 415/211.2 |
| 4,421,457 | 12/1983 | Yoshinaga et al. | 415/208.3 |
| 4,428,715 | 1/1984 | Wiggins | 415/199.2 |
| 4,493,611 | 1/1985 | Funakoshi et al. | 415/199.1 |
| 4,626,168 | 12/1986 | Osborne et al. | 415/208.3 |
| 4,844,695 | 7/1989 | Banks et al. | 415/914 |
| 4,887,940 | 12/1989 | Todoroki et al. | 415/199.1 |

FOREIGN PATENT DOCUMENTS

| | | | |
|---|---|---|---|
| 125764 | 8/1949 | Sweden | 415/100 |
| 67781 | 4/1893 | Switzerland | 415/199.1 |

*Primary Examiner*—John T. Kwon
*Attorney, Agent, or Firm*—Antonelli, Terry, Stout & Kraus

[57] ABSTRACT

A single-shaft multi-staged turbo compressor capable of compressing a gas at a large flow rate and with a high pressure ratio has a first impeller group composed of at least one oblique-flow impeller and a second impeller group composed of at least one centrifugal impeller. The impellers of the first and second groups are mounted on a common impeller shaft in a back-to-back relation.

14 Claims, 6 Drawing Sheets

TURBO COMPRESSOR

BACKGROUND OF THE INVENTION

The present invention relates to turbo compressor having a plurality of impellers for compressing a gas such as air and, more particularly, to a turbo compressor for compressing a gas at a high flow speed and a large compression ratio.

In general, a turbo compressor has a plurality of centrifugal impellers carried by an impeller shaft in a plurality of stages through which the gas such as air is progressively compressed and then discharged. Conventional multi-stage turbo compressors for compressing a gas with large compression ratio and at large flow rate are complicated in construction, and include a large number of stages, i.e., impellers, in order to avoid any reduction in the efficiency. In order to avoid this problem, U.S. Pat. No. 4,224,010 proposes a turbo compressor in which the angle formed between the axis of the impeller shaft and the direction in which the compressed gas is discharged from an impeller is less than that in the impeller immediately downstream from the impeller, when viewed in a meridional plane. This conventional construction provides a turbo compressor which operates with a comparatively high operating efficiency and has a comparatively small size, but cannot satisfactorily meet current demands of engineering firms and end users for turbo compressors which operate with high levels of compression ratio and flow rate. Namely, in order to handle a large amount of gas, it is necessary that impellers of high specific rate are arranged on a single impeller shaft in a multiplicity of stages. On the other hand, high pressure ratio requires that the peripheral velocities of the impellers are increased or, alternatively, the number of the impellers is increased. Unfortunately, however, there is a practical limit in the peripheral velocity of the impeller from the view point of the mechanical strength of the impeller material. This naturally leads to a conclusion that the number of the impellers be increased. A greater number of impellers requires a correspondingly greater length of the impeller shaft, posing problems or difficulty in regard to the critical speed and dynamic behavior of the rotor. For these reasons, known turbo compressors can not satisfactorily meet the demands for greater flow rate and higher pressure ratio.

A diagonal flow type compressor is mentioned in Proceedings of the Sixth Turbo machinery Symposium (October 1977), pp 61–62. A compressor also is known in which diffusers are bent in radial directions, i.e., perpendicularly to the axis of the impeller shaft, as reported in Bulletin of the Japan Association of Mechanical Engineering, March 1987, pp 16–20.

In general, when the specific speed ns, that is the ratio between the diameter of the inlet end of the impeller and the diameter of the outlet end of the impeller is increased so that curvature is increased when centrifugal impellers are used, the performance of the compressor is impaired. The specific speed ns is determined in accordance with the following relationship:

$$ns = N \cdot \sqrt{Q} / H_{od} 0.75,$$

where:

N = a rotational speed (rpm),

Q = a volumetric flow rate of gas ($m^3$/min), and $H_{od}$ = an adiabatic head (m).

In the case of the diagonal flow type impeller, the curvature of the flow path in meridional plane is small so that a substantially uniform breadthwise flow distribution is obtained at the outlet of the impeller, i.e., at the inlet of the diffuser, thus eliminating offset of the flow of the gas towards a core plate. However, if the flow of the gas entering the diagonal flow diffuser has a rotational component, the flow of the gas is offset towards a side plate in the region between an intermediate portion and the outlet of the diffuser due to the curvature in the direction perpendicular to the direction of path of the gas. When this offset tendency is enhanced to an extreme level, a reverse flow may be produced around the core plate so that the diffuser loss is drastically increased. A diagonal flow type compressor employing a diffuser of the type described above inevitably has a large axial length so that the friction loss along the flow passage is increased correspondingly. In addition, the critical speed of the shaft system is undesirably lowered due to an increased length of the impeller shaft. In order to overcome these problems, a compressor has been proposed in which guide vanes of a height of 10 to 50% of the meridional plane are provided in the diffuser at positions adjacent to the core plate as disclosed, for example, in Japanese Utility Model Laid-Open Publication No. 56-38240. Such guide vanes, however, cannot provide satisfactory effect. Thus, problems such as difficulty in the reduction of size, increase in the friction loss, lowering of the critical speed and so forth still remain unsolved.

SUMMARY OF THE INVENTION

Accordingly, an object of the present invention is to provide a turbo compressor which can meet the demands for greater flow rate and higher pressure ratio.

Another object of the present invention is to provide a small sized turbo compressor with a superior performance.

To these ends, according to the present invention, a turbo compressor is provided including a plurality of impellers mounted on an impeller shaft so as to form a plurality of stages through which a gas is progressively compressed, with at least one first impeller having a gas outlet angle such that the gas discharged from the outlet of the first impeller flows in a direction which is inclined from the radial direction towards the axial direction of the impeller shaft when viewed in a meridional plane and with at least one second impeller having a gas outlet angle such that the gas discharged from the second impeller flows in the radial direction of the impeller shaft, and wherein the first and second impellers are mounted on the impeller shaft in a back-to-back relationship with respect to each other.

The expression back-to-back relation, as used herein, means an arrangement in which the impellers are arranged with suction sides thereof disposed adjacent to ends of the impeller shaft and discharge sides of the impellers are disposed adjacent to a center of the impeller shaft.

According to another aspect of the present invention, a turbo compressor is provided having a plurality of impellers mounted on an impeller shaft so as to form a plurality of stages through which a gas is progressively compressed, with a first impeller group including at least one first impeller of an open type without a shroud and having a gas suctioning section adjacent to one end of the impeller shaft and a gas discharging section adjacent to a longitudinal center of the impeller shaft, and a second impeller group including at least one second impeller and having a gas suctioning section provided adjacent to the other end of the impeller shaft and connected to the discharge section of the first impeller group. The second impeller group includes a discharging section adjacent to the discharging section of the first impeller group.

According to still another aspect of the present invention, a turbo compressor is provided including at least one diagonal-flow impeller having a gas outlet angle such that the gas discharged from the impeller flows in a direction which is inclined from the radial direction of the impeller, when viewed in a meridional plane, and a diffuser provided on the downstream end of the impeller and composed of a first diffuser plate adjacent to an inlet side of the impeller and a second diffuser plate adjacent to an outlet side of the impeller. The diffuser has an inlet coinciding with the gas outlet angle of the impeller and an outlet directed in the radial direction of the impeller, with the diffuser being curved in the radial direction in a region adjacent to the outlet of the impeller. The diffuser is also provided with a plurality of guide vanes arranged in an annular row on the curved region of the first diffuser plate, with the guide vanes having a height which ranges between 20% and 50% of the breadth of the diffusion flow passage defined between the first and second diffuser plates.

In a preferred form of the invention, the guide vanes are designed such that the inlet and outlet angles of the guide vanes are substantially equal to the design mean flow angle at the outlet of the impeller.

A gas such as air is compressed first by the first impeller and then introduced to the second impeller so as to be compressed to a higher pressure. Since the volumetric flow rate of the gas suctioned by the second impeller is reduced because the gas has been compressed through the first impeller, it is possible to reduce the diameter of the inlet opening of the second impeller. In other words, the specific speed of the second impeller can be reduced as compared with the first impeller in an amount corresponding to the reduction in the volumetric flow rate so that the compression efficiency is improved corresponding to the reduction in the specific speed. On the other hand, the first impeller can compress a large volume of gas. It is thus possible to obtain a turbo compressor which can compress a gas at a large volumetric flow rate with a high pressure ratio.

In a preferred form of the invention, guide vanes are disposed on the curved portion of the diffuser plate adjacent to the inlet side of the impeller, with the guide vanes having a height smaller than the breadth of the diffuser passage and inlet and outlet angle substantially equal to the mean flow angle at the impeller outlet. In this arrangement, gas discharged from the impeller is guided by the guide vanes to flow smoothly along the surface of the diffuser plate while maintaining the mean flow angle. The portion of th flow path in the diffuser downstream of the curved region has a small curvature, when viewed in a meridional plane so that the flow of the gas is uniformalized in the breadthwise direction of the diffuser, whereby the performance of the turbo compressor is further improved.

These and other objects, features and advantages of the present invention will become clear from the following description of the preferred embodiments when the same is read in conjunction with the accompanying drawings.

DESCRIPTION OF THE PREFERRED EMBODIMENTS

Figure 1:
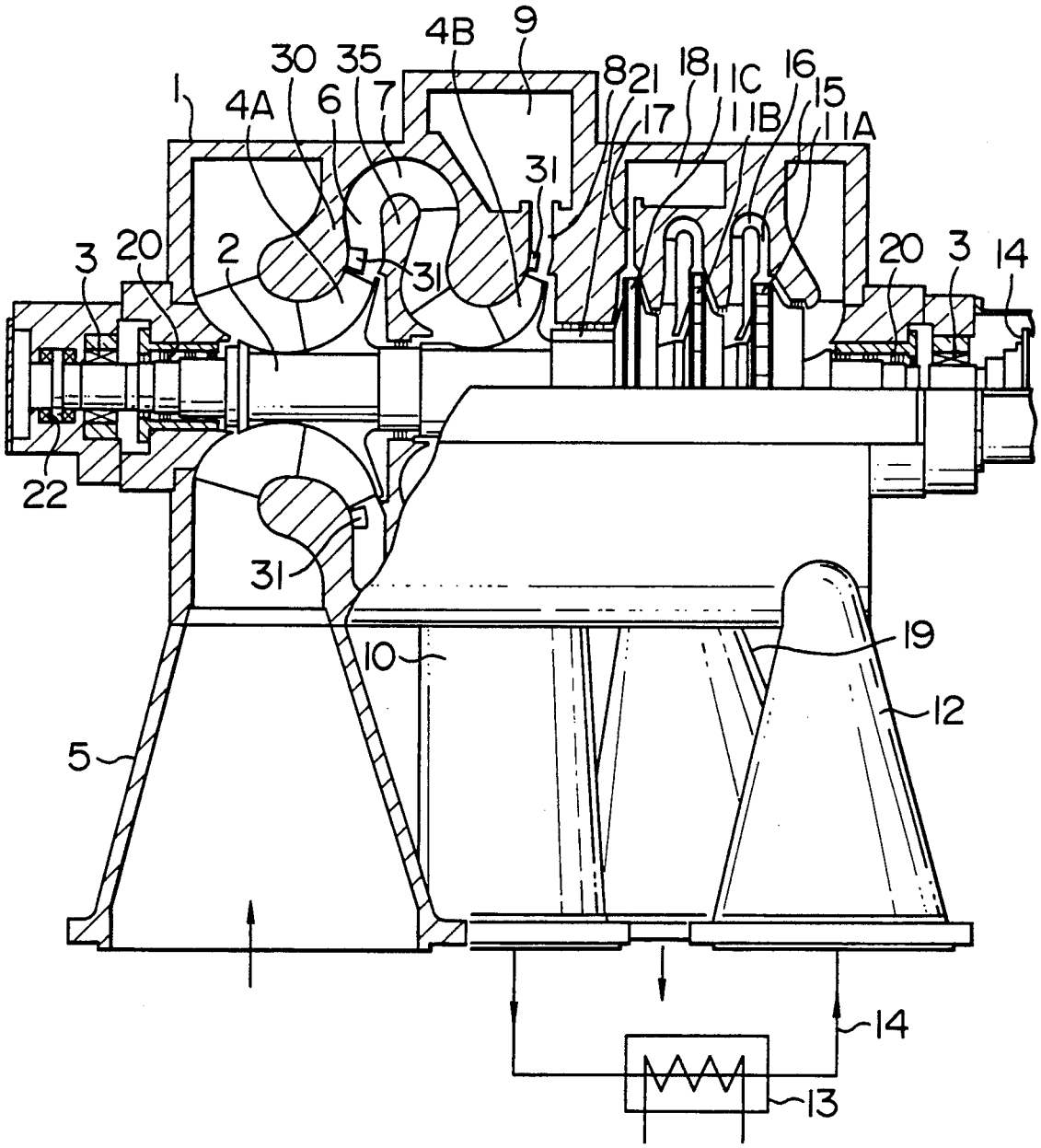
FIG. 1 is a partial cross-sectional side elevationa view of an embodiment of a turbo compressor in accor dance with the present invention.
Figure 4:
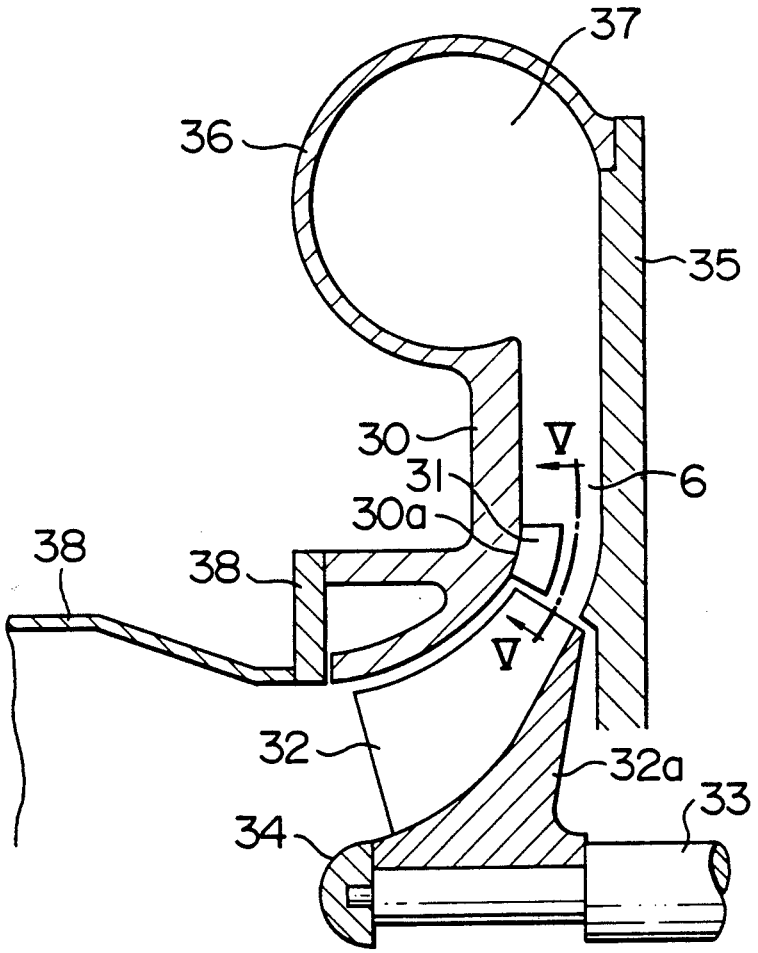
FIG. 4 is a partial cross-sectional side elevationa view of a part of a turbo compressor composed of a single stage of a diagonal flow impeller similar to the first or the second stage of the multi-stage turbo com pressor of FIG. 1.

Referring to FIG. 1, in accordance with the presen invention, an impeller shaft 2 is rotatably supported by a casing 1 through a pair of bearings 3, 3 mounted in the casing 1. Impellers 4A, 4B form of a first group of impellers, with the impeller 4A being mounted on a portion of the impeller shaft 2 near one end of the shaft 2 and the impeller 4B is mounted on the impeller shaft 2 at one side of the impeller 4A opposite to the above-mentioned one end of the impeller shaft. Both the impellers 4A and 4B of the first group are non-shrouded or open-type diagonal flow type impellers which have predetermined discharge angles, that is gas outlet angles, with respect to the axis of the impeller shaft withir a meridional plane. A suction duct 5 is provided for the first-stage impeller 4A, with a diffuser 6 being provided for the same. As shown in FIG. 4, the diffuser 6 is ben radially with respect to the axis of the impeller shaft ir the region near the outlet of the impeller 4A. The diffuser 6 is defined between a diffuser plate 30 adjacent tc an end plate and a diffuser plate 35 adjacent to a core plate. A plurality of guide vanes 31 are disposed in ar annular row on the curved portion of the surface of the diffuser plate 30 facing the flow passage so as to project into the flow passage in the diffuser 6. A return passage 7 guides the gas radially inwardly so as to introduce the gas into the second-stage impeller 4B, with a diffuser 8 being provided for the second-stage impeller 4B. As with the diffuser 6 for the first-stage impeller **4*a*, the diffuser 8 is formed by being bent radially with respec to the axis of rotation. A discharge scroll section 9 is provided for the impellers 4A, 4B of the first group with a discharge duct 10 being connected to the discharge scroll section 9**.

The turbo compressor further has impellers 11A, 11B and 11C of a second group, with the impellers 11A, 11B and 11C of the second group being carried by the impeller shaft and arranged in the mentioned order from the end of the impeller shaft opposite to the end carrying the impellers 11A, 11B of the first group towards the center of the impeller shaft. The impellers 11A, 11B anc 11C of the second group are centrifugal impellers for discharging gas in the radial direction, that is, at a right angle to the axis of the impeller shaft, when viewed in a meridional plane. Thus, the impellers 11A to 11C of the second group and the impellers 4A, 4B of the first group are carried by the impeller shaft in a back-to-back relationship. More particularly, the first and second groups of the impellers are arranged in the impeller shaft such that the suction sides of the two impeller groups are disposed adjacent to the opposite ends of the impeller shaft while the discharge sides of the two impeller groups are disposed adjacent to the center of the impeller shaft. A suction duct 12 of the impeller 11A of the second group connected to the discharge duct 10 of the impeller 4B of the first group through a duct 14 which has an inter-cooler 13. Communication between the impellers 11A and 11B of the second group is made through a diffuser 15 and a return passage 16 and a similar communication is provided also between the impeller 11B and the impeller 11C of the second group. A diffuser 17 is provided for the final stage impeller 11C of the second group, with discharge scroll section 18 and a discharge duct 19 also being provided. The discharge scroll section 9 of the impeller 4B of the first group forms an axial scroll cavity around the impeller 4B so as to reduce the radial dimension of the compressor. Seal sections 20 are provided, with a thrust control 21 also being drum provided on the portion of the impeller shaft 2 between the impeller 4B of the first and the impeller 11C of the second group. The thrust control drum 21 functions to control the axial thrust on the impeller shaft 2 such that a thrust generated by the impellers 4A, 4B of the first group and acting to the left, as viewed in FIG. 1, is slightly greater than the thrust generated by the impellers 11A to 11C of the second group acting to the right, as viewed in FIG. 1. This slight difference in the thrust is carried by a thrust bearing 22 provided on one end of the impeller shaft 2. The impeller shaft 2 is connected at its other end to a prime mover (not shown).

In operation, the gas is suctioned into the first-stage impeller 4A of the first group through the suction duct 5 so as to compressed to a higher pressure and is then introduced to the impeller 4B of the next stage so as to be further compressed to a higher pressure. The impellers 4A,4B of the first group have greater specific speeds than those of the impellers 11A to 11C of the second group so that they can handle a large volume of the gas. The gas compressed in the impeller 4B of the first group is introduced into the impeller 11A of the second group through the intermediate cooler 13, duct 14 and the suction duct 12. The impellers 11A to 11B of the second group progressively compress the gas to higher pressure and the gas, thus compressed, is discharged through the discharge duct 19. The volumetric flow rate of the gas entering the second group of impellers 11A to 11C is small because the gas already has been compressed by the impellers 4A, 4B of the first group. It is therefore possible to design the impellers 11A to 11C of the second group such that the ratios of the inlet diameters to the outside diameter of the impellers are small. In other words, the specific speeds of the impellers 11A to 11C of the second group can be decreased by amounts corresponding to the reduction in the volumetric flow rate caused by the compression performed by the impellers 4A, 4B of the first group. Consequently, the impellers 11A to 11C of the second group can operate with efficiency maximized correspondingly to the reduction in the specific speed.

From the foregoing description, it will be understood that this embodiment of the turbo compressor of the invention can compress a gas at a large flow rate and with a high compression ratio. In addition, since the impellers 4A, 4B of the first group and the impellers 11A to 11C of the second group are disposed in a back-to-back relationship, it is possible to form ample suction spaces for the first-stage impeller 4A of the first group and the first-stage impeller 11A of the second group at the respective ends of the impeller shaft 2, so that offset of the flow of the suctioned gas is suppressed to reduce the levels of noise and vibration.

Figure 2:
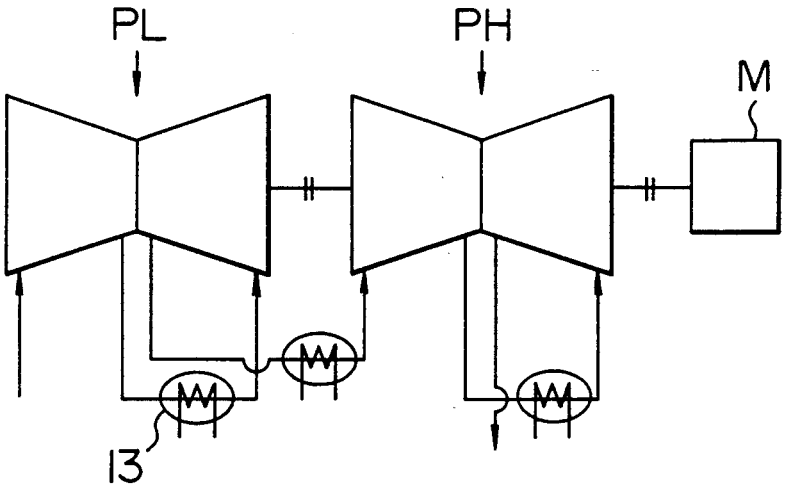
FIGS. 2 and 3 are schematic views of different ar rangements in which a plurality of turbo compressors ir accordance with the present invention are combined.

FIG. 2 illustrates a system in which a pair of turbo compressors of the type shown in FIG. 1 are coupled at the impeller shafts. Namely, the system has a low-pressure stage composed of a turbo compressor which has impellers of the first and second groups as shown in FIG. 1, and a high-pressure stage composed of a turbo compressor of a similar construction, with the low- and high-pressure stages being coupled in tandem manner at their impeller shafts 2, and with the prime mover M connected to one end of the impeller shaft of one of the two stages. This arrangement enables a greater volume of gas to be compressed with a greater pressure ratio. In addition, since the low- and high-pressure stage compressors PL and PH are mounted on the same impeller shaft, any overhang of the impeller shaft of the low-pressure stage compressor, necessary for coupling, can be eliminated so as to increase the resonance frequency of the impeller shaft, thus allowing the low-pressure stage compressor PL to operate at an increased speed.

Figure 3:
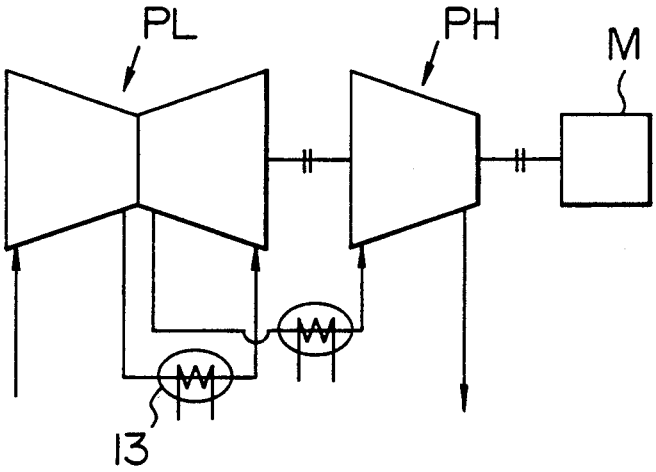

FIG. 3 shows a system having a low-pressure stage PL composed of a turbo compressor of the type shown in FIG. 1 and a high-pressure stage PH composed of a turbo compressor having a plurality of centrifugal impellers. It will be clear to those skilled in the art that the arrangement of FIG. 3 offers the same advantages as those brought about by the arrangement shown in FIG. 2.

Figure 5:
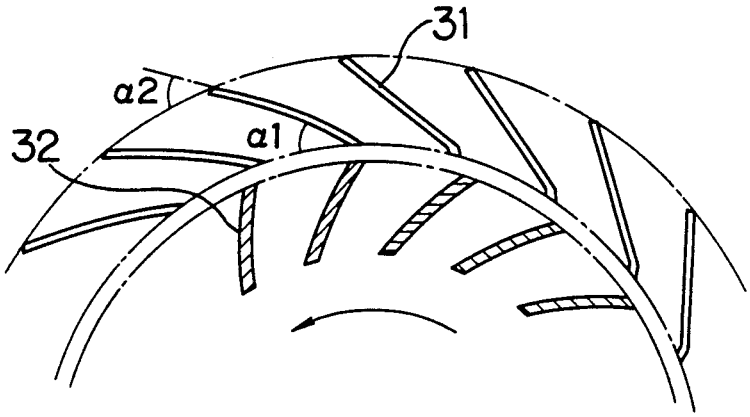
FIG. 5 is a sectional view taken along the line V—V of FIG. 4.

FIGS. 4 and 5 show a turbo compressor which is composed of a single stage of the diagonal-flow impeller similar to that of the first or second stage of the turbo compressor shown in FIG. 1. Thus, the impellers 4A and 4B of the first and second stages in the turbo compressor of FIG. 1 have constructions substantially the same as the single-staged diagonal-flow turbo compressor shown in FIGS. 4 and 5. In other words, each of the first and second stages of the turbo compressor of FIG. 1 can be used alone so as to form a single-stage turbo compressor of FIGS. 4 and 5.

Referring to FIGS. 4 and 5, a diagonal-flow impeller 32 having a small curvature of flow passage in a meridional plane is fixed to an impeller shaft 33 by a nut 34. A pair of diffuser plates 30, 35 having curvatures in the region near the outlet of the impeller 32 is disposed around the impeller 32. These diffuser plates 30 and 35 in cooperation form a diffuser 6 defining a flow passage which is curved in a region near the outlet of the impeller 32. One of the diffuser plates 30 may be disposed adjacent to a side plate of the impeller, if provided while the other diffuser plate 35 is positioned adjacent to a core plate 32*a* of the impeller 32. A plurality of guide vanes 31 are arranged in an annular row on the curved portion of the surface of the diffuser pate 30 facing the flow passage. The height of the guide blades 31, as measured from the base end to the free end of each vane, is so determined that the guide vanes not fully occupy the axial breadth of the flow passage in the diffuser but project only to an intermediate portion of the breadth of the flow passage. More specifically, the height of the guide vanes is in a range of between 20% and 50% of the axial breadth of the flow passage, and preferably about 40% of the flow passage. In addition, the vane inlet angle $\alpha_1$ and the vane outlet angle $\alpha_2$ are determined to be equal to the design mean flow angle at the outlet of the diagonal flow impeller 32 which is the mean value of the angle formed between the absolute velocity of the fluid at the impeller outlet and the direction tangential to the impeller outlet at design flow rate. The reason why the height of the guide vanes 31 is determined to range between 20% and 50% of the axial breadth of the flow passage is as follows. Namely, a guide vane height which is not greater than 20% of the breadth of the passage significantly reduces the effect for preventing reversing flow which tends to occur at the curved portion of the passage. On the other hand, a guide vane height not less than 50% of the breadth of the passage, e.g., 100%, causes a tremendous increase in the attack loss (loss caused by difference between the angle of flow of fluid at the vane inlet and the vane angle) when the flow rate is increased or decreased from the design value, often resulting in a reduction of the performance of the compressor.

A casing 36 defines a discharge flow passage 37 at the outer peripheral ends of the diffuser plates 30 and 35. In addition, a suction duct 38 is connected to the gas suction end of the diffuser plate 30.

The operation of this turbo compressor is as follows.

Figure 6:
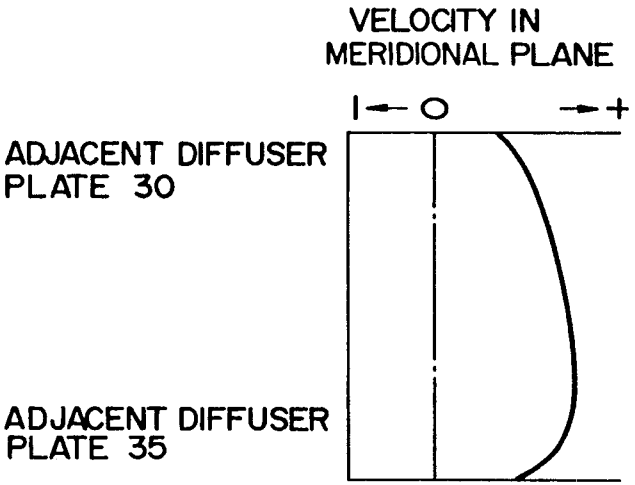
FIG. 6 is a flow velocity distribution diagram in a meridional plane at the impeller outlet of the compres sor shown in FIG. 4.

A gas is suctioned into the impeller 32 through the suction duct 38 and is discharged at an elevated pressure into the diffuser 6. The flow of the gas is decelerated in the diffuser 6 and is introduced into the passage defined by the casing 36. Since the curvature of the flow path in the diagonal-flow impeller 32 in the meridional plane is small, the flow of the gas is uniformly distributed in the breadthwise direction at the outlet of the impeller. Therefore, the angle of the flow component of the gas adjacent to the diffuser plate 30 on the impeller outlet at the design flow rate of substantially equal to the mean flow angle so that this flow component is allowed to flow into the diffuser 6 without substantially colliding with the guide vanes 31. The flow of the gas introduced into the diffuser is forcibly guided by the guide vanes 31 without being separated from the surface of the diffuser plate 30 so as to reach the outlet of the guide vanes 31. The curvature of the flow path in the meridional plane is small in the region near the outlet of the guide vanes 31, that is, at the terminal end of the bent portion 30*a* of the passage so that the flow of the gas is forcibly guided by the guide vanes so as to exhibit a substantially uniform breadthwise flow distribution as shown in FIG. 6.

Figure 7:
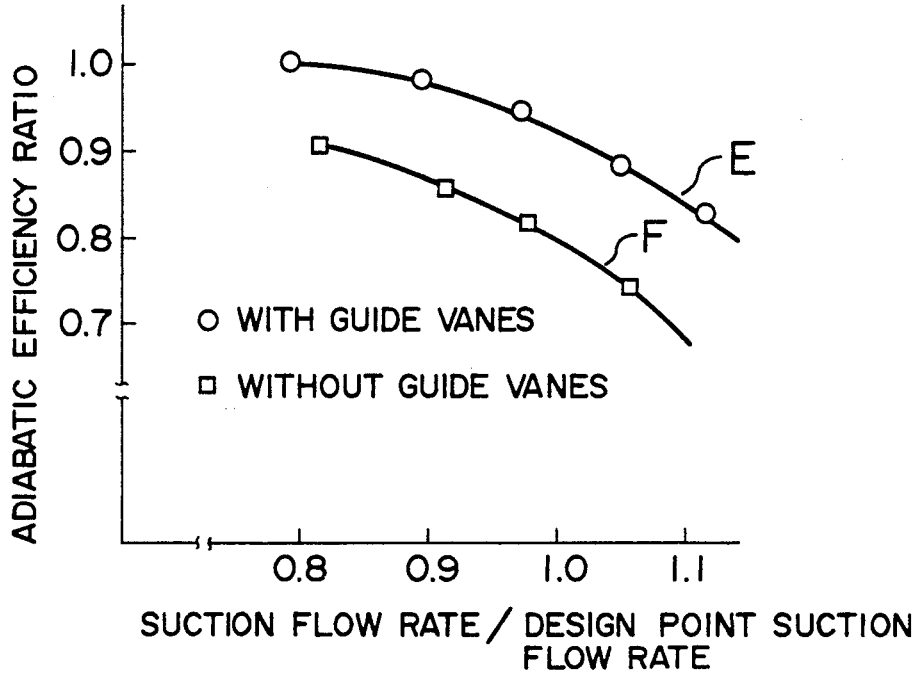
FIG. 7 is a diagram illustrative of the performance o the turbo compressor of FIG. 4 in comparison with the performance of a conventional turbo compressor.
Figure 9:
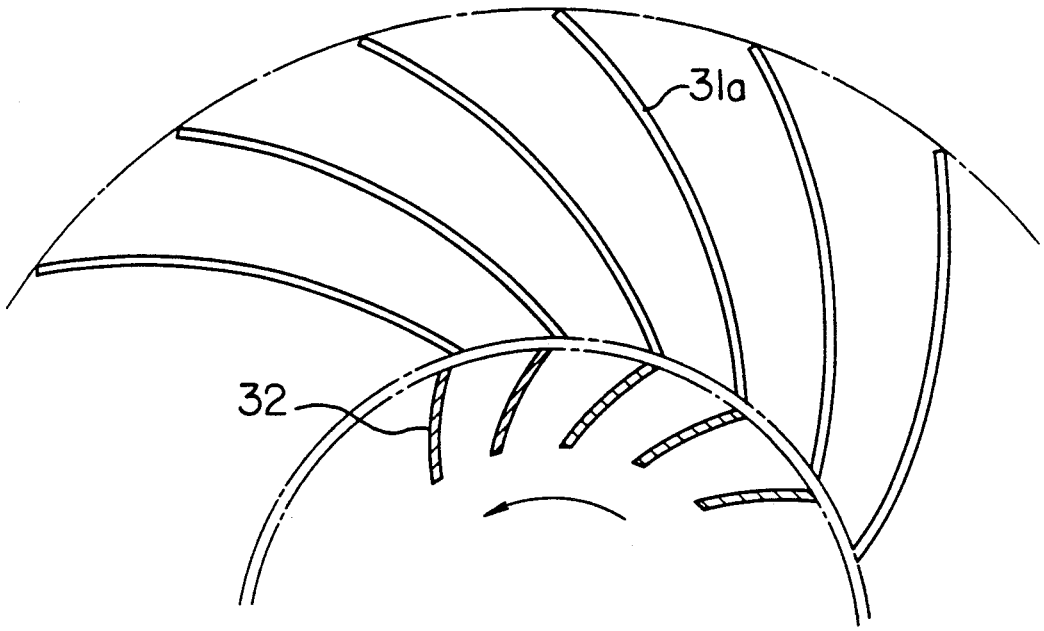
FIG. 9 is a sectional view taken along the line IX—IX of FIG. 8.

FIG. 7 is a graph explanatory of the advantage of the turbo compressor of FIG. 4. More specifically, this graph shows the adiabatic efficiency of the diagonal-flow turbo compressor of the invention in comparison with a conventional diagonal-flow compressor employing a curved diffuser without guide vanes. A curve F shows the adiabatic efficiency ratio in relation to varying suction flow rate in the conventional diagonal-flow compressor, while a curve E shows the adiabatic efficiency ratio in the diagonal-flow compressor of the invention shown in FIGS. 4 and 5, using the maximum value of the adiabatic efficiency attained by the diagonal-flow compressor of the invention as the reference value (1.0).

As apparent from FIG. 7, the diagonal-flow turbo compressor of the invention shown in FIGS. 4 and 5 attains a remarkable improvement in the adiabatic efficiency over the conventional diagonal-flow turbo compressor having a diffuser without guide vanes.

Thus, according to the present invention, it is possible to prevent exfoliation of the flow at the bent portion of the diffuser in the diagonal-flow compressor so that the loss at the curved portion of the diffuser is significantly reduced. In addition, the flow of the gas is uniformalized in the breadthwise direction of the flow passage at the guide vane outlet. For these reasons, the performance of the portion of the diffuser downstream from the guide vanes is remarkably improved. Furthermore, since the flow path in the diffuser is curved in the radial direction as viewed in a meridional plane, the length of the flow path is reduced as compared with that in the conventional oblique-flow diffuser. This effectively contributes both to a reduction in the friction loss and reduction in the axial size of the diffuser and thus in the axial length of the impeller shaft. It is therefore possible to remarkably improve the performance of the diagonal-flow compressor over conventional diagonal-flow compressor and to raise the critical speed of the shaft system of the compressor.

As in the case of the embodiment shown in FIG. 4, the diffuser 6 is composed of a pair of curved diffuser plates 30 and 35 and a plurality of guide vanes 31*a* arranged in an annular row on the surface of the diffuser plate 30 facing the flow passage. In this modification, however, the guide vanes 31*a* have a large length so as to extend not only over the curved region 30*a* of the diffuser plate 30 but also to cover a substantially straight portion of the diffuser plate. The guide vanes 31*a* are so designed that the inlet and outlet angles of these guide vanes are substantially equal to the design mean flow angle at the outlet of the impeller. As in the case of the compressor shown in FIG. 4, the guide vanes 31*a* have a height in a range of between 20% and 50% of the breadth of the flow passage in the diffuser.

Figure 8:
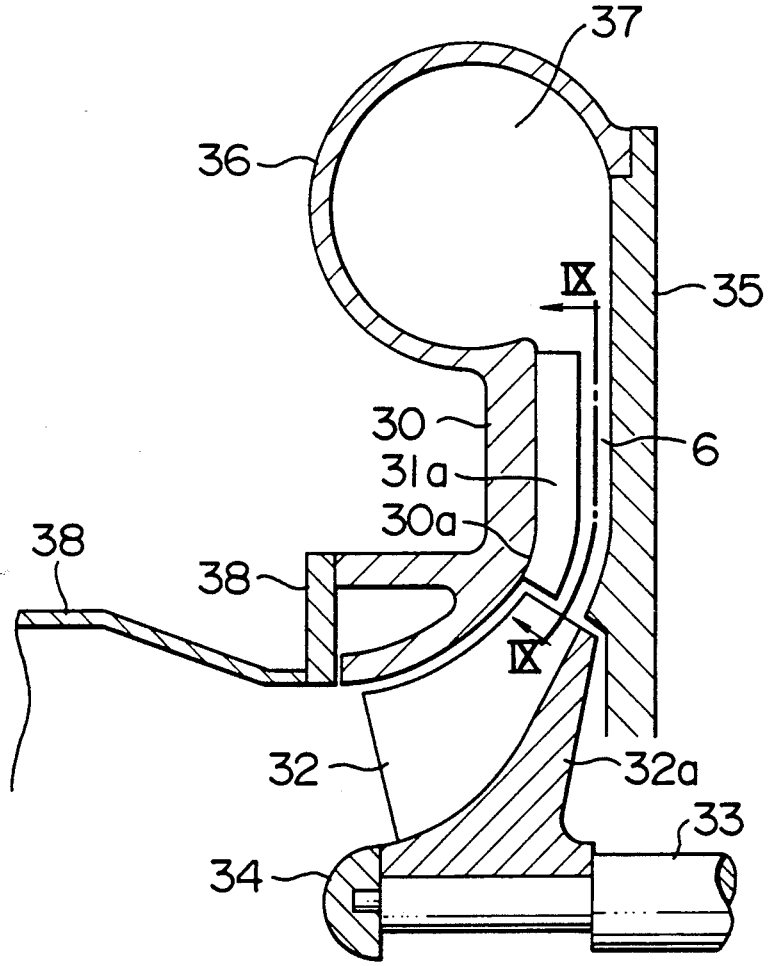
FIG. 8 is a modification of the turbo compressor o FIG. 4 employing a different form of guide vanes; anc

The oblique-flow compressor shown in FIG. 8 offers the same advantages as that produced by the oblique-flow compressor of FIG. 4. Namely, the flow component adjacent to the diffuser plate 30 on the outlet side of the oblique-flow impeller 32 is guided by the guide vanes 31*a* without any exfoliation from the diffuser plate 30 so as to reach the outlet end of the curved region in the diffuser. Consequently, the flow of the gas is uniformly distributed in the breadthwise direction at the outlet of the curved region. If the substantially straight portion of the diffuser plate 30 downstream of the curved region is devoid of the guide vanes 31*a*, any offset of the flow of gas tends to become greater towards the downstream end of the diffuser. In the oblique-flow turbo compressor shown in FIG. 8, however, a uniform flow distribution is maintained along the substantially straight portion of the diffuser pate 30 by virtue of the guide vanes 31*a* which extends along this substantially straight portion of the diffuser plate 30. Consequently, the performance of the diffuser and, hence, the performance of the diagonal-flow compressor are further improved over the diagonal-flow compressor shown in FIG. 4. The diagonal-flow compressor shown in FIG. 8 also can have a reduced axial length because the path of flow of the fluid in the diffuser 6 is directed radially in the meridian plane, thus offering reduction in the size of the compressor and the critical speed of the shaft system.

What is claimed is:

1. A turbo compressor having a plurality of impellers mounted on an impeller shaft so as to form a plurality of stages through which a gas is progressively compressed, comprising:

at least one open-type non-shrouded first impeller having a gas outlet angle such that gas discharged from the outlet of said first impeller flows in a direction which is in line from the radial direction towards the axial direction of said impeller shaft when viewed in a meridional plane; and at least one second impeller having a gas outlet angle such that gas discharged from said second impeller flows in the radial direction of said impeller shaft, said first and second impellers being mounted on said impeller shaft such that inlet sides of said impellers are disposed adjacent to opposite ends of said impeller shaft with outlet sides of said impellers being disposed adjacent to a center of said impeller shaft.

2. A turbo compressor according to claim 1, wherein a first group of impellers composed of said first impellers and a second group of impellers composed of said second impellers are provided, and wherein a gas suctioning section is provided on the inlet side of the first stage impeller of each of said first and second groups.

3. A turbo compressor according to claim 1, further comprising: a discharge duct connected to the outlet of a final stage impeller of a first group of impellers; an intermediate duct through which said discharge duct is connected to a gas inlet section of a second group of impellers, and an inter-cooler provided in said intermediate duct.

4. A turbo compressor having a plurality of impellers mounted on an impeller shaft so as to form a plurality of stages through which a gas is progressively compressed, comprising:

at least one first impeller having such a gas outlet angle that the gas discharged from the outlet of said first impeller flows in a direction which is in line from the radial direction towards the axial direction of said impeller shaft when viewed in a meridian plane; and at least one second impeller having such a gas outlet angle that the gas discharged from said second impeller flows in the radial direction of said impeller shaft, said first and second impellers being mounted on said impeller shaft in a back-to-back relation to each other, and wherein said first impeller is an diagonal-flow impeller, while said second impeller is a centrifugal impeller.

5. A turbo compressor according to claim 4, further comprising a diffuser provided on the outlet side of said first impeller.

6. A turbo compressor according to claim 5, wherein said diffuser is curved in a radial direction of said impeller shaft when viewed in a meridional plane at a region of said diffuser substantially directly downstream of the outlet of said first impeller, and wherein said diffuser is formed by a first diffuser plate adjacent to an front side of said first impeller and a second diffuser plate adjacent to an back side of said first impeller, said diffuser being provided with guide vanes disposed on a surface of said first diffuser plate and extending at least over the curved portion.

7. A turbo compressor according to claim 6, wherein said guide vanes have a height in a range of between 20% and 50% of a breadth of a diffuser passage defined between said first and second diffuser plates.

8. A turbo compressor having a plurality of impellers mounted on an impeller shaft so as to form a plurality of stages through which a gas is progressively compressed, comprising:

a first impeller group including at least one first open-type non-shrouded impeller and having a gas suctioning section adjacent to one end of said impeller shaft and a gas discharging section adjacent to a longitudianl center of said impeller shaft; and a second impeller group including at least one second impeller and having a gas suctioning section providing adjacent to the other end of said impeller shaft and connected to said discharging section of said first impeller group, said second impeller group having a discharge section adjacent to the discharging section of said first impeller group, wherein said first impeller group includes a plurality of diagonal-flow impellers arranged in stages, and wherein an inter-cooler is provided in a passage through which said discharging section of said first impeller group is connected to the suctioning section of said second impeller group.

9. A turbo compressor according to claim 8, further comprising:

a diffuser provided on the outlet side of a final stage impeller of said first impeller group, said diffuser being curved in a radial direction of said impeller shaft when viewed in a meridional plane at a region of said diffuser substantially directly downstream of an outlet of said final stage impeller; and guide vanes provided on the curved portion of said diffuser and having a height in a range of between 20% and 50% of a breadth of a flow passage in said diffuser.

10. A turbo compressor comprising:

at least one diagonal-flow impeller having a gas outlet angle such that gas discharged from said impeller flows in a direction inclined from the radial direction of said impeller when viewed in a meridional plane; and a diffuser provided on the downstream end of said impeller and including a first diffuser adjacent to an front side of said impeller and a second diffuser adjacent to an back side of said impeller, said diffuser having an inlet coinciding with said gas outlet angle of said impeller and an outlet directed in the radial direction of said impeller, said diffuser being curved in the radial direction in a region adjacent to the outlet of said impeller, said diffuser being provided with a plurality of guide vanes arranged in an annular row on the curved region of said first diffuser, said guide vanes having a height less than a breadth of a diffusion flow passage defined between said first and second diffusers, said guide vanes having inlet and outlet angles substantially equal to the design mean flow angle at the outlet of said impeller.

11. A turbo compressor according to claim 10, wherein said height of said guide vanes is in a range of between 20% and 50% of said breadth of said diffusion flow passage.

12. A turbo compressor comprising:

at least one diagonal-flow impeller having a gas outlet angle such that gas discharged from said impeller flows in a direction inclined from the radial direction of said impeller when viewed in a meridional plane; and a diffuser provided on a downstream end of said impeller and including a first diffuser plate adjacent to an front side of said impeller and a second diffuser plate adjacent to an back side of said impeller, said diffuser having an inlet coinciding with said gas outlet angle of said impeller and an outlet directed in the radial direction of said impeller, said diffuser having a curved portion curving in the radial direction in a region adjacent to the outlet of said impeller and a substantially radially extending straight portion connected to said curved portion, said diffuser being provided with a plurality of guide vanes arranged in an annular row on said first diffuser plate and extending along said curved portion and said straight portion, said guide vanes having a height in a range of between 20% and 50% of a breadth of a diffusion flow passage defined between said first and second diffuser plates.

13. A turbo compressor according to claim 12, wherein said guide vanes have an inlet angle and an outlet angle which are substantially equal to the design mean flow angle at the outlet of said impeller.

14. A turbo compressor according to claim 12, wherein said height of said guide vanes is about 40% of said breadth of said diffusion flow passage.

* * * * *